US008348311B2

(12) United States Patent
Helms

(10) Patent No.: US 8,348,311 B2
(45) Date of Patent: Jan. 8, 2013

(54) LEVER MECHANISM FOR AN EMERGENCY ESCAPE HATCH

(75) Inventor: James M. Helms, Fort Myers, FL (US)

(73) Assignee: Ibis Tek, LLC, Butler, PA (US)

( * ) Notice: Subject to any disclaimer, the term of this patent is extended or adjusted under 35 U.S.C. 154(b) by 506 days.

(21) Appl. No.: 12/586,540

(22) Filed: Sep. 23, 2009

(65) Prior Publication Data

US 2010/0084876 A1 Apr. 8, 2010

Related U.S. Application Data

(60) Provisional application No. 61/195,081, filed on Oct. 3, 2008.

(51) Int. Cl.
*B65D 45/00* (2006.01)

(52) U.S. Cl. ..... 292/256.5; 292/DIG. 65; 292/DIG. 30

(58) Field of Classification Search ..... 292/256.5, 292/256, 256.75, DIG. 65 X, DIG. 5, DIG. 27, 292/DIG. 30 X, DIG. 31, DIG. 42, DIG. 43, 292/DIG. 49, 92, 200
See application file for complete search history.

(56) References Cited

U.S. PATENT DOCUMENTS 5,002,002 A * 3/1991 Awalt, Jr. ..... 114/210
6,511,105 B1 * 1/2003 Sakamoto ..... 292/113

* cited by examiner

*Primary Examiner* — Carlos Lugo
*Assistant Examiner* — Mark Williams
(74) *Attorney, Agent, or Firm* — Karen Tang-Wai Sutton

(57) ABSTRACT

A lever mechanism for holding an escape hatch onto a vehicle surface covering an opening in the vehicle surface, for enabling emergency escape through the escape hatch. The lever mechanism includes a base portion, a handle portion and a clamp portion, with the handle portion and clamp portion linked so that by pushing on the handle portion, and so placing the lever mechanism in its engaged state, the clamp portion is pushed against the vehicle surface, drawing the escape hatch against the vehicle surface. By pulling on the handle portion of the lever mechanism, and so placing the lever mechanism in its disengaged state, the clamp is pulled up and away from the vehicle surface and clear of the opening in the vehicle surface, thus allowing the escape hatch to be pushed out away from the vehicle surface, thereby enabling emergency egress.

5 Claims, 9 Drawing Sheets

LEVER MECHANISM FOR AN EMERGENCY ESCAPE HATCH

CROSS REFERENCE TO RELATED APPLICATION

Reference is made to and priority claimed from U.S. provisional application Ser. No. 61/195,081, filed Oct. 3, 2008.

TECHNICAL FIELD

The present invention pertains to the field of armored vehicles. More particularly, the present invention pertains to mechanisms allowing escape from such a vehicle in the case of the normal exit not being accessible, i.e. mechanisms providing emergency egress.

BACKGROUND OF THE INVENTION

There are situations in which personnel travelling in an armored vehicle require the ability to quickly exit the vehicle through an opening other than the existing doors. For example, in the event of an attack that renders the normal exit routes—vehicle door or hatch—inoperable, personnel require the ability to rapidly exit the vehicle to avoid further harm or danger. Mechanisms that allow for such exiting of a vehicle are here called emergency escape/egress mechanisms, and include mechanisms for enabling escape/egress from a vehicle through openings that are not used during normal operation.

In the case of an armored vehicle, the prior art provides various mechanisms for emergency escape through the (bulletproof) windows of a vehicle, but the designs for such escape are specific to windows, in that equipment/hardware used in enabling emergency egress through a window cannot obstruct the view through the window prior to use for an emergency egress. Further, the windows in some vehicles make emergency access difficult. Finally, for some kinds of vehicles, there are areas of the vehicle surface that can accommodate an escape hatch for emergency egress, either in addition to or instead of windows configured for emergency egress. Thus, what is needed is an escape hatch providing emergency egress through some other vehicle surface other than the windows of a vehicle, i.e. through an opaque section of the vehicle surface.

DISCLOSURE OF INVENTION

Accordingly, the invention provides a low-profile lever mechanism for holding an escape hatch on a vehicle surface. The lever mechanism is attached to the side of the escape hatch facing into the vehicle, and is low profile in that it does not protrude excessively into the interior of the vehicle. Typically at least two such lever mechanisms are used—for holding the escape hatch in two places on the vehicle surface. The lever mechanism is designed so as to allow freeing of the escape hatch from the vehicle surface by pulling on a handle portion of each lever mechanism, thus enabling emergency egress after the freed escape hatch is pushed out away from the vehicle surface, creating an opening for the emergency egress.

BRIEF DESCRIPTION OF THE DRAWINGS

The features and advantages of the invention will become apparent from a consideration of the subsequent detailed description presented in connection with accompanying drawings, in which.

DRAWINGS LIST OF REFERENCE NUMERALS

Figure 1:
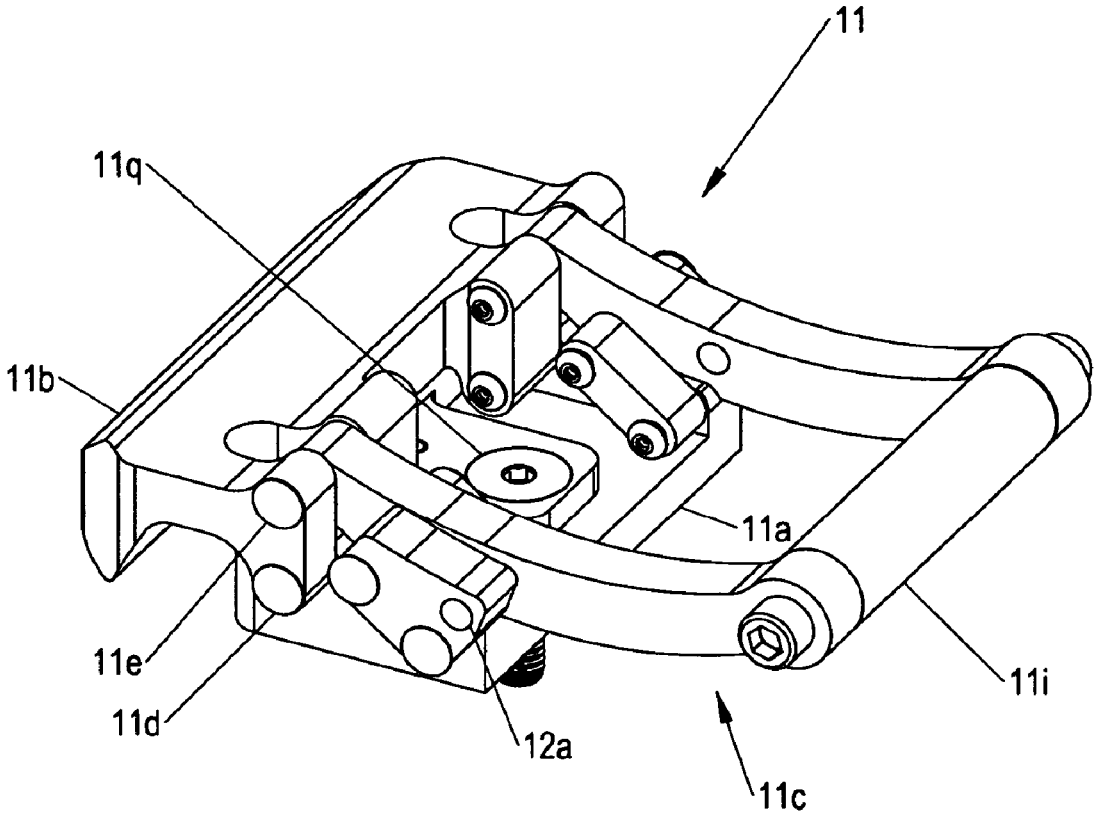
FIGS. 1, 2, and 3 are perspective drawings of a lever mechanism, according to an embodiment of the invention, in its engaged state, an intermediate state between its engaged state and its disengaged state, and its disengaged state, respectively.

The following is a list of reference labels used in the drawings to label components of different embodiments of the invention, and the names of the indicated components.

11 lever mechanism
11*a* base
11*b* clamp
11*c* handle
11*d* clamp pivot pin
11*e* handle pivot pin
11*f* handle-base linkage
11*g* vehicle surface
11*h* hatch lip section
11*i* handle grip
11*j* lock link
11*k* simple link
11*m* escape hatch
11*q* base bolt hole
11*s* base-linkage pin
11*t* handle-linkage pin
11*u* base bolt
12 lock pin
12*a* opening in the lock link for the lock pin
12*b* opening in the handle for the lock pin

DETAILED DESCRIPTION

The invention provides a low-profile lever mechanism for use in holding an escape hatch onto a vehicle surface, and for freeing the escape hatch from the vehicle surface to allow emergency egress from the vehicle. The lever mechanism is affixed to the inward-facing side of the escape hatch, and is fairly characterized as a low-profile mechanism in that it is of a design that protrudes only minimally into the vehicle. The body of the escape hatch can be provided as one or more sheets of various materials, either bonded together to form a rigid structure, or including at least one rigid material.

Referring now to FIGS. 1-9, a lever mechanism 11 according to an embodiment of the invention includes a base ll*a* configured for attaching to an escape hatch ll*m* (see especially FIG. 6), means for attaching the base to the escape hatch using a base bolt 11*u* (FIG. 4) inserted through a base-bolt hole 11*q* (FIG. 1), and in some embodiments, using two spaced apart base alignment pins (not shown) protruding from the underside of the base 11*a* on either side of the base bolt hole 11*q*, for inserting into corresponding holes in the escape hatch 11*m* in order to keep the lever mechanism 11 from twisting or pivoting about the base bolt 11*u*. The lever mechanism 11 also includes a clamp 11*b* pivotally attached to the base 11*a* via two spaced apart collinear clamp pivot pins 11*d*, and also includes a handle 11*c* pivotally attached to the clamp 11*b* and means for pivotally attaching the handle to the clamp via two spaced apart collinear handle pivot pins 11*e*, and also coupled to the base 11*a* via two spaced apart handle-base linkage assemblies 11*f*, one of which assemblies may include provisions for a lock pin 12, as described below.

Figure 2:
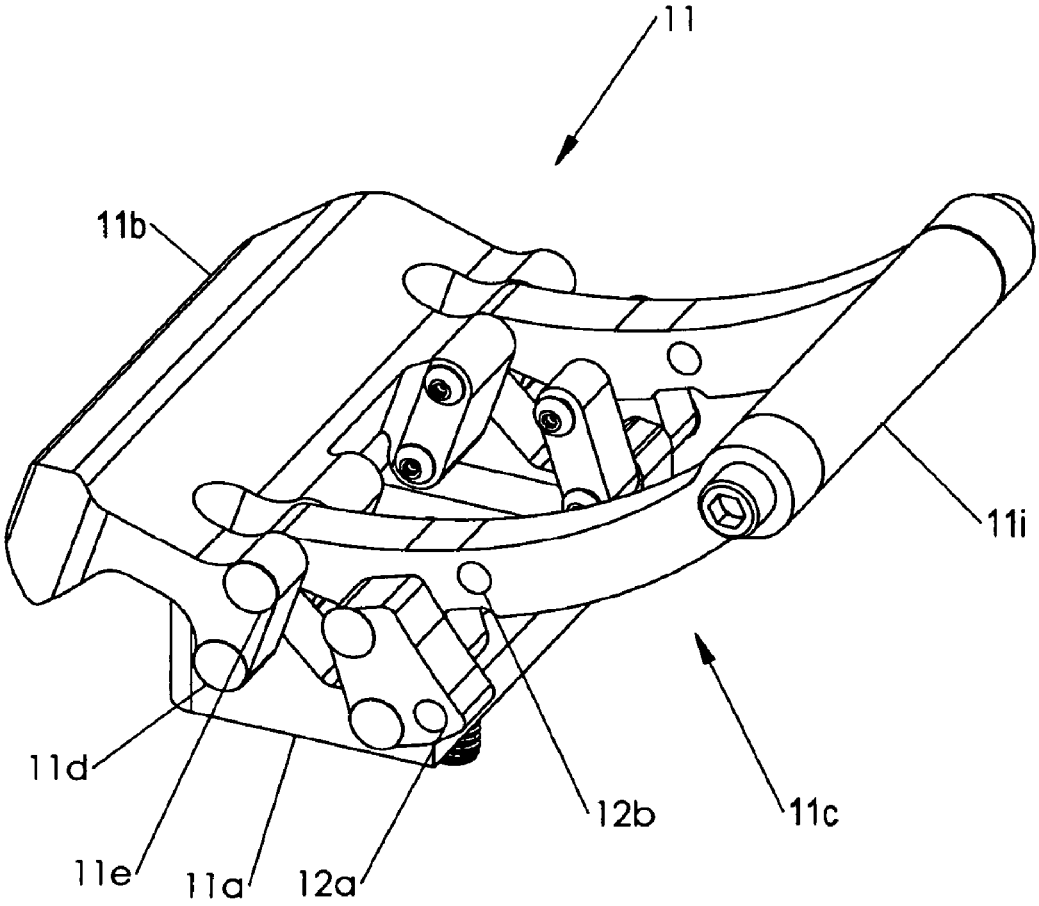
Figure 3:
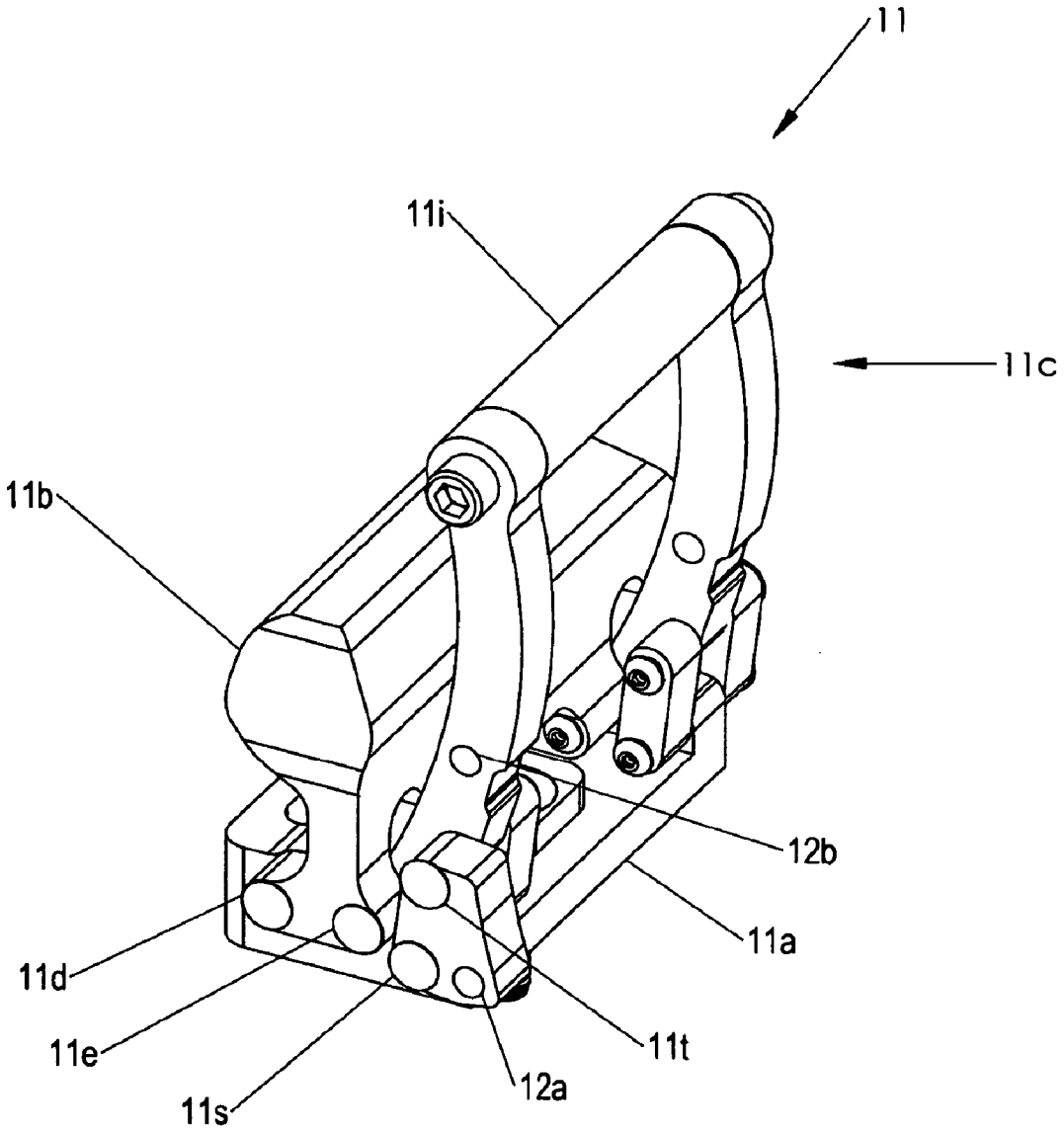

As can be understood by referring especially to FIGS. 1-3, the pivoting motion of the handle 11*c* is tied to the pivoting motion of the clamp 11*b*. By virtue of the handle-base linkage assemblies 11*f* (shown more particularly in FIG. 4), as the handle 11*c* is (manually) pivoted, the clamp 11*b* also pivots. More specifically, and as further described below, with the lever mechanism 11 in its engaged state as shown in FIG. 1, as the handle 11*c* is pivoted about the handle pivot pin 11*e*, the handle-base linkage assemblies 11*f* (shown in FIG. 4) cause the handle pivot pin 11*e* to move from the position shown in FIG. 1 to the position shown in FIG. 3, where the lever mechanism 11 is in its disengaged state. This happens because the handle-base linkage assemblies 11*f* are pivotally attached to the base 11*a* via base-linkage pins 11*s*, and also pivotally attached to the handle 11*c* via handle-linkage pins 11*t*.

Figure 7:
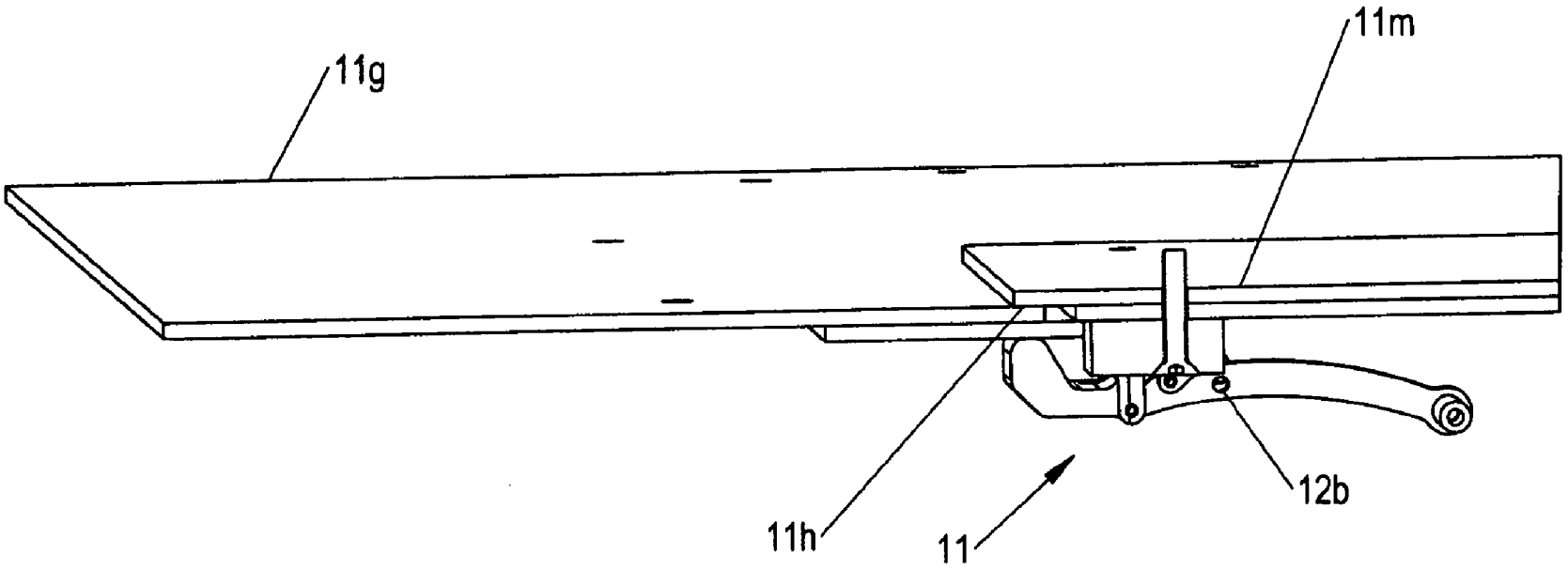
FIG. 7 is a perspective drawing showing in a cutaway view a lever mechanism according to the invention attached to an escape hatch and in its engaged state (so as to hold the escape hatch onto a vehicle surface), illustrating how a lip portion of the escape hatch protrudes over a portion of the surface of the vehicle.
Figure 8:
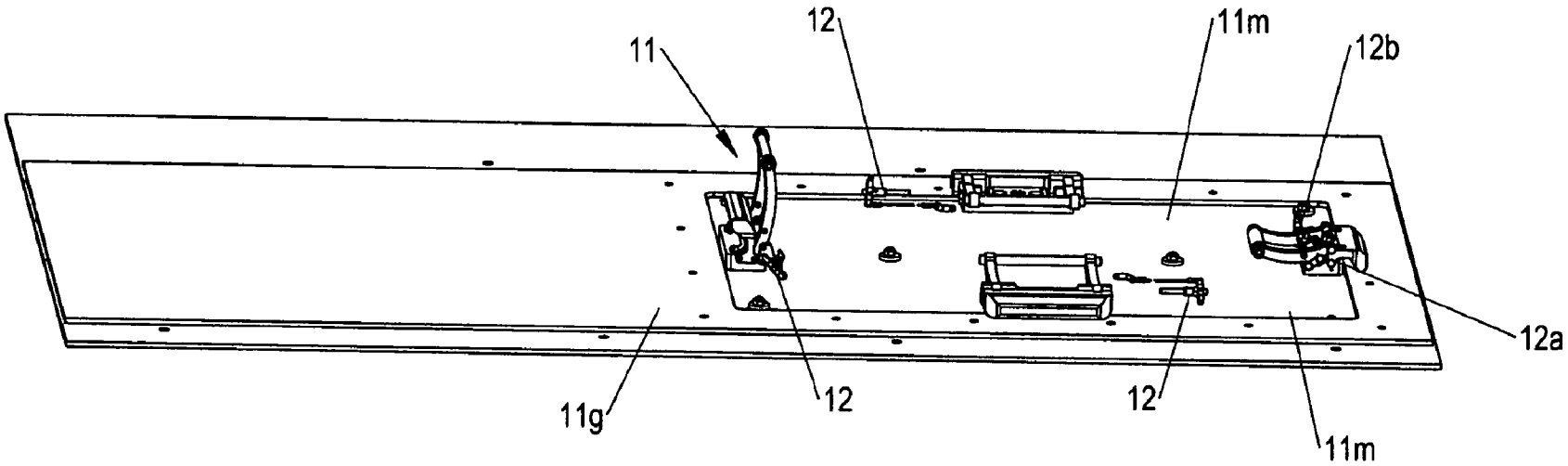
FIG. 8 is a perspective drawing showing an escape hatch held on a vehicle surface using four lever mechanisms according to the invention, with one of the lever mechanisms in the disengaged state, and showing a lock pin holding the other three lever mechanisms in the engaged state.

The escape hatch 11*m* includes a (hatch) lip (section) 11*h* (as shown in FIG. 7), and the hatch and lip are sized so as to allow placing the escape hatch over an opening in a (typically) top surface of a vehicle, with the lip 11*h* extending outward over the vehicle surface 11*g*, beyond the opening, and so preventing the hatch 11*m* from falling through the opening into the vehicle. With the base 11*a* attached to the escape hatch 11*m* and the escape hatch placed on the opening of the vehicle surface (see FIGS. 6-8), in order to lock the escape hatch, a vehicle occupant pushes on the handle toward the surface of the vehicle, using a handle grip 11*i* of the handle, so as to place the lever mechanism 11 in the closed/engaged position (FIG. 1). The pushing causes the clamp 11*b* to draw the hatch toward the surface of the vehicle, by virtue of the handle-clamp pivots (the handle pivot pins 11*e*) and clamp-base pivots (the clamp pivot pins 11*d*), and the handle-base linkage assemblies 11*f*. The clamp 11*b* then holds the escape hatch onto the surface of the vehicle until the hatch is opened by an occupant pulling on the handle grip 11*i* so as to pivot the handle grip 11*i* outward away from the escape hatch into an opened/disengaged position (FIG. 3), which causes the clamp to also draw away from the vehicle surface (the portion of the vehicle surface mating with the escape hatch lip) by pivoting about the clamp pivot pins 11*d*. FIG. 2 shows an intermediate stage of the lever, between the opened/disengaged and the closed/engaged positions.

Figure 4:
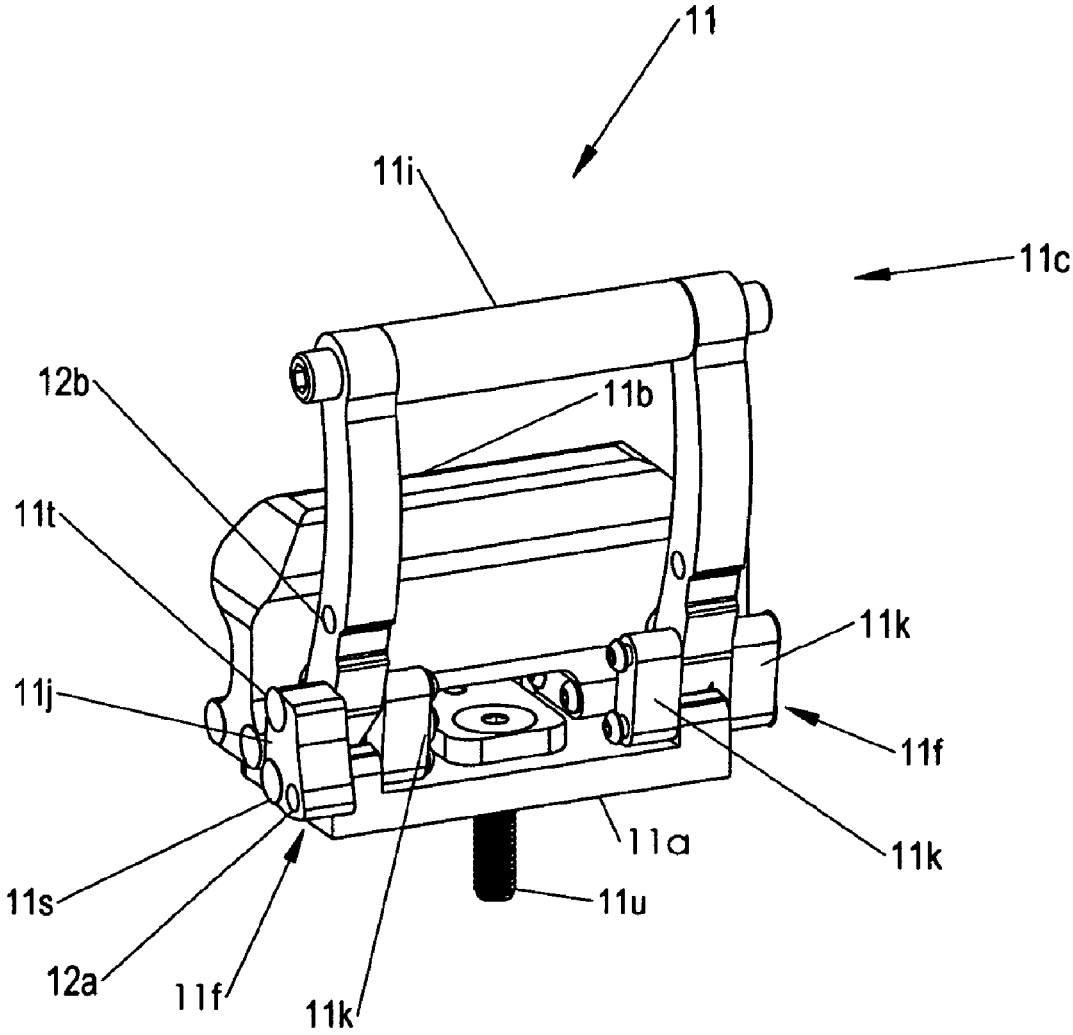
FIGS. 4 and 5 are further perspective drawings of the lever mechanism of FIGS. 1-3, in its disengaged state.
Figure 5:
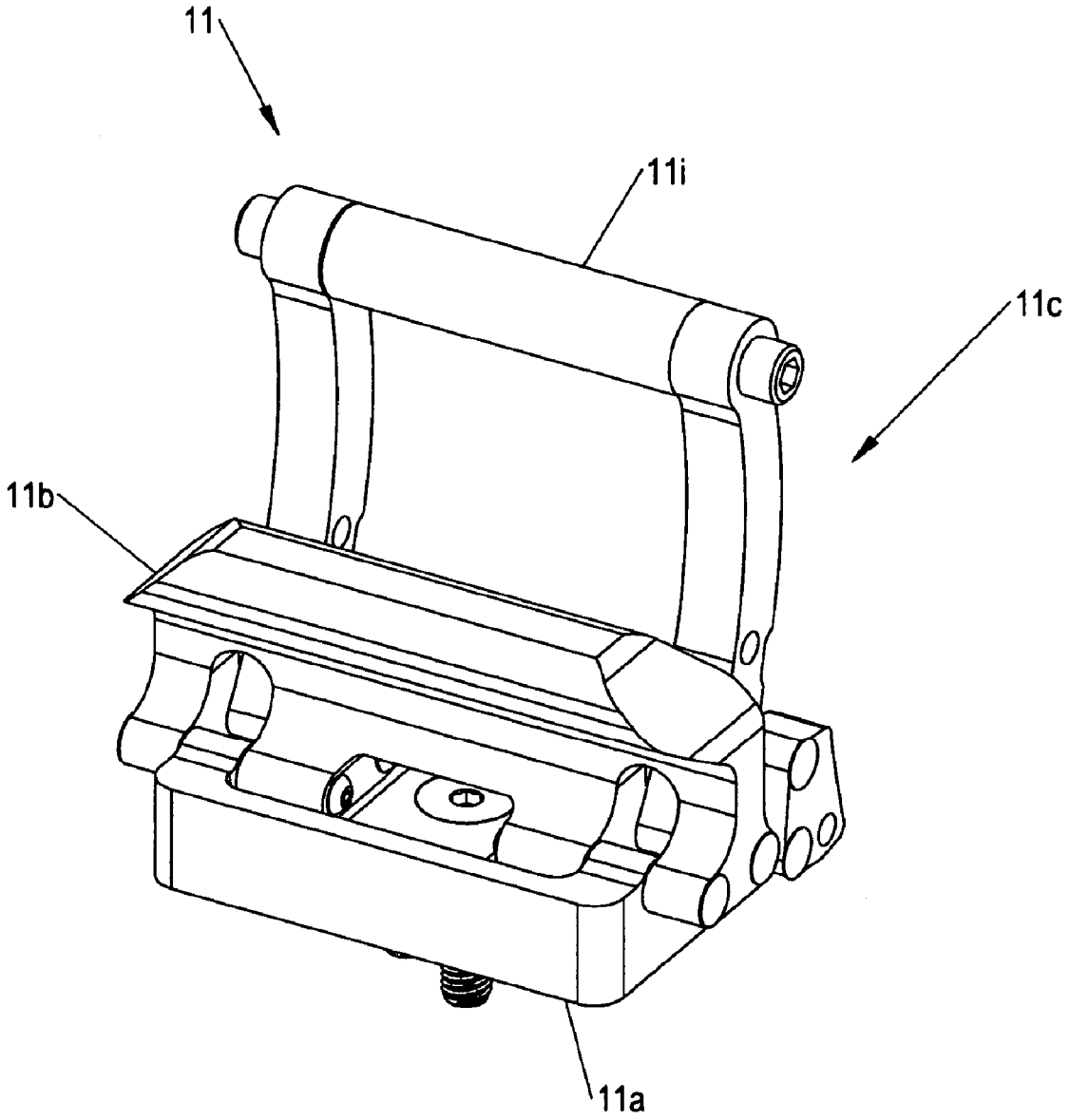
Figure 6:
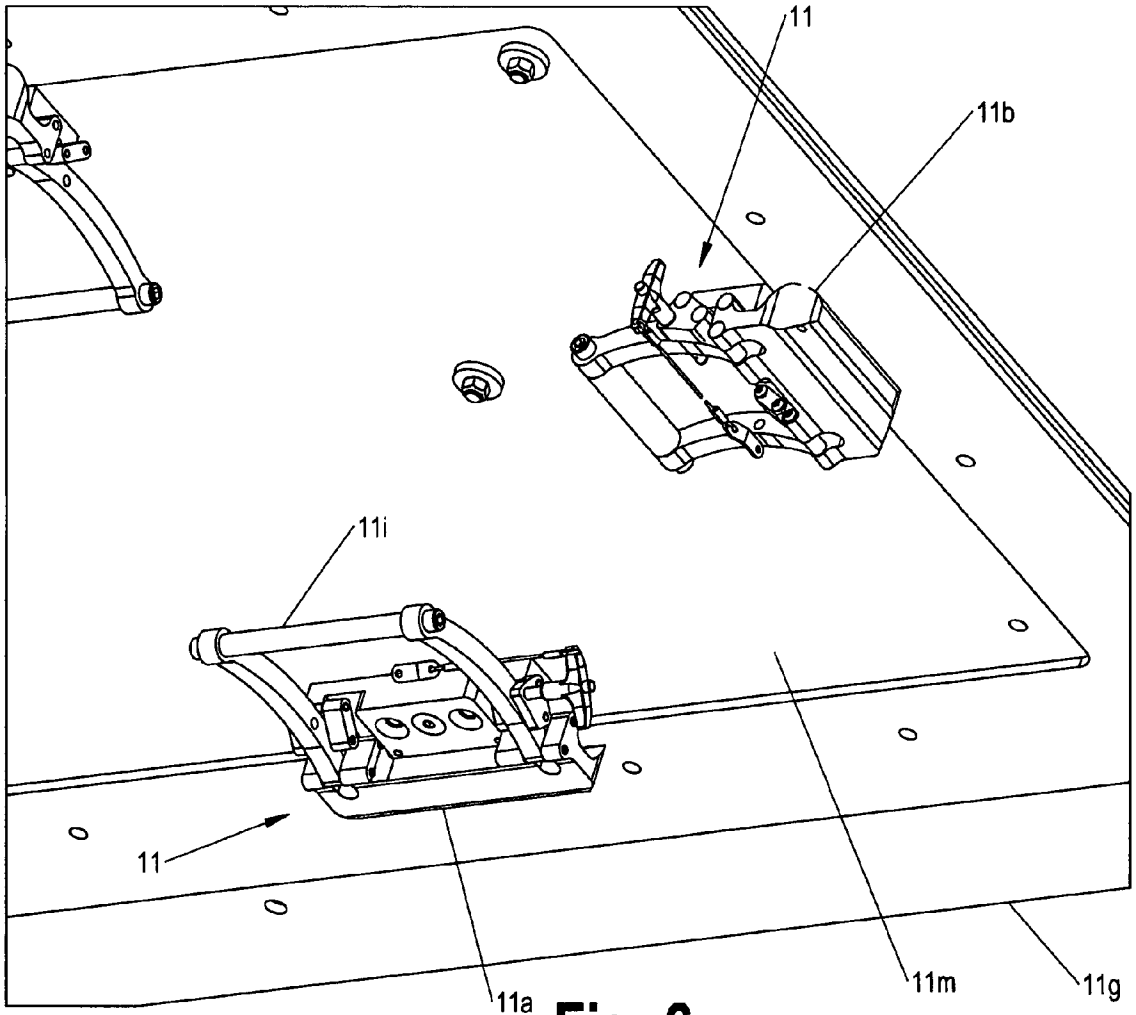
FIG. 6 is a perspective drawing showing two lever mechanisms according to the invention, attached to a section of vehicle surface (one lever mechanism in the engaged state, and one in the disengaged state).
Figure 9:
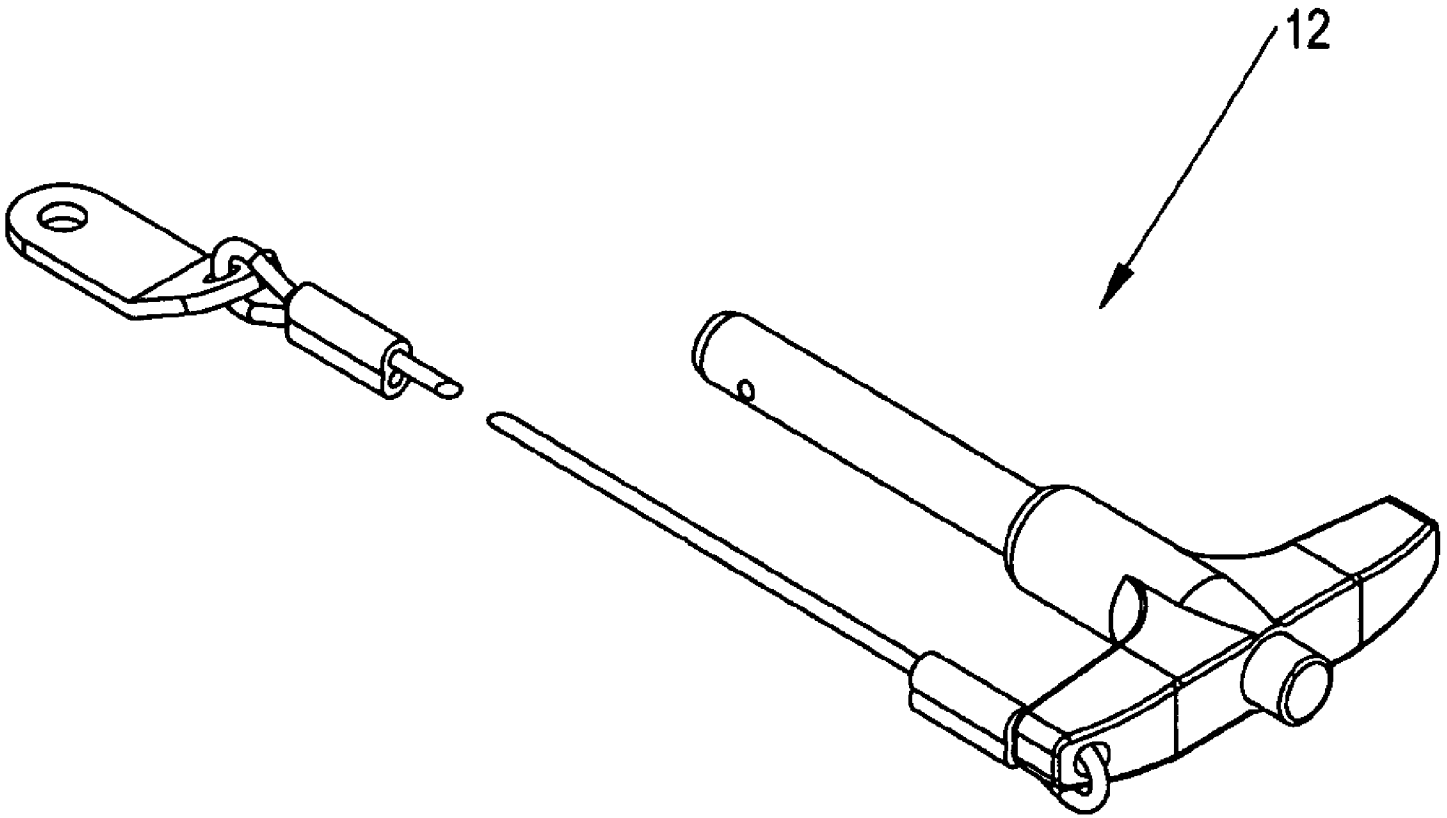
FIG. 9 is a perspective drawing of the lock pin shown in FIG. 8, in more detail.

Referring now to FIGS. 3 and 4, the two handle-base linkage assemblies 11*f* are shown in more detail as comprising a lock link 11*j* and three links 11*k* referred to here as simple links. As explained above, each simple or lock link element accommodates two pins, the base-linkage pin 11*s* for pivotal attachment of the (simple or lock) link to the base, and the handle-linkage pin 11*t* for pivotal attachment of the (simple or lock) link to the handle. By pivotally attaching a (simple or lock) link to the handle and also to the base, each handle-base linkage pivotally attaches the handle to the base. The lock link 11*j* differs from any one of the simple links only in that it has additional body/material sufficient to feature means for locking the lever mechanism in an engaged position, namely a hole for accommodating a lock pin 12 and the lock pin 12 itself (FIG. 9). The lock pin is pushed through the opening 12*a* in the lock link and also through an opening 12*b* in the handle that aligns with the hole in the lock link when the lever is in the closed/engaged position (FIG. 1).

The embodiment of the lever mechanism described herein is primarily constructed from metallic materials, typically Aluminum 6061 T6, and the lever mechanism may be red-anodized for corrosion protection.

Although the invention is shown and described for applications where two or more lever mechanisms according to the invention are used, it is also possible, of course, to use the invention in case of a hinged escape hatch, and in such an application, only a single lever mechanism according to the invention is needed.

It is to be understood that the above-described arrangements are only illustrative of the application of the principles of the present invention. Numerous modifications and alternative arrangements may be devised by those skilled in the art without departing from the scope of the present invention.

What is claimed is:

1. A lever mechanism (11) suitable for holding an escape hatch on a surface of a vehicle (11*g*), the escape hatch having a topside and an underside, with the topside to be mounted on the vehicle facing outward away from the inside of the vehicle, the lever mechanism comprising:

a base (11*a*) having a distal edge and a proximal edge, and means for rigidly affixing the base to the underside of the escape hatch (11*m*);

a clamp (11*b*) having an attached end and a surface clamping end;

two spaced apart collinear clamp pivot pins (11*d*) inserted into both the base and into the clamp;

a handle (11*c*), the handle further comprising a handle grip (11*i*), and means for pivotally attaching the handle to the clamp; and two spaced apart handle-based linkage assemblies (11*f*), at least one of the two spaced apart handle-based linkage assemblies further comprising a simple link (11*k*), wherein the handle is pivotally coupled to the base by the two spaced apart handle-based linkage assemblies (11*f*); and wherein the attached end of the clamp is pivotally coupled to the base by the two spaced apart collinear clamp pivot pins (11*d*);

whereby a user pushing the handle towards the underside of the escape hatch pivotally moves the clamp against the vehicle surface (11*g*) and causes the lever mechanism to move into an engaged position, wherein in the engaged position the surface clamping end of the clamp extends past the distal edge of the base and the handle grip (11*i*) extends past the proximal edge of the base, and the user pulling on the handle pivotally moves the clamp away from the vehicle surface and causes the lever mechanism to move into a disengaged position, wherein in the disengaged position the surface clamping end is oriented a distance away from the vehicle surface so that the surface clamping end is repositioned over the distal edge of the base, and the handle grip (11*i*) is oriented a distance away from the underside of the escape hatch so that the handle grip (11*i*) is repositioned over the proximal edge of the base.

2. The lever mechanism of claim 1, further comprising means for locking the lever mechanism in an engaged position.

3. The lever mechanism (11) of claim 1, wherein at least one of the two spaced apart handle-based linkage assemblies further comprises at least one lock link (11*j*) and a lock pin (12), wherein the lock link further is formed with a hole (12*a*) and wherein the handle (11*c*) is further formed with a hole (12*b*), both holes (12*a*) (12*b*) to accommodate the lock pin first inserted through the hole (12*a*) of the lock link (12*j*) and then inserted through the hole (12*b*) of the handle (11*c*).

4. The lever mechanism of claim 1, wherein means for pivotally attaching the handle (11*c*) to the clamp (l1*b*) comprises at least two spaced apart collinear handle pivot pins (11*e*) inserted through both the clamp and the handle.

5. The lever mechanism of claim 1, wherein means for affixing the escape hatch (11*m*) to the base (11*a*) comprises a base bolt (11*u*) and two base alignment pins, and wherein the escape hatch includes a base bolt hole (11*q*) and is formed so as to have two additional spaced apart holes, one on either side of the base bolt hole, wherein the base bolt is inserted through the base bolt hole and the base alignment pins are inserted though the additional spaced apart holes, whereby the lever mechanism is rigidly affixed to the escape hatch and prevented from pivoting about the base bolt.

* * * * *